US005938362A

United States Patent [19]

Bastiansen

[11] Patent Number: 5,938,362

[45] Date of Patent: Aug. 17, 1999

[54] WRITING IMPLEMENT FOR INK

[75] Inventor: Bernd Bastiansen, Wedel, Germany

[73] Assignee: Rotring International GmbH & Co. KG, Hamburg, Germany

[21] Appl. No.: 09/029,759

[22] PCT Filed: Sep. 27, 1996

[86] PCT No.: PCT/EP96/04223

§ 371 Date: Mar. 2, 1998

§ 102(e) Date: Mar. 2, 1998

[87] PCT Pub. No.: WO97/12765

PCT Pub. Date: Apr. 10, 1997

[30] Foreign Application Priority Data

Oct. 2, 1995 [DE] Germany ..... 195 38 501

[51] Int. Cl.[6] ..... B43K 5/18; B43K 7/10

[52] U.S. Cl. ..... 401/209; 401/227; 401/199

[58] Field of Search ..... 401/199, 209, 401/255, 227–229

[56] References Cited

U.S. PATENT DOCUMENTS

| | | | |
|---|---|---|---|
| 2,512,004 | 6/1950 | Wing | 401/225 |
| 4,645,367 | 2/1987 | Mutschler et al. | 401/199 |
| 4,671,692 | 6/1987 | Inaba | 401/199 |
| 5,551,789 | 9/1996 | Okawa et al. | 401/199 |

FOREIGN PATENT DOCUMENTS

| | | |
|---|---|---|
| 2 569 615 | 3/1986 | France . |
| 3421417 A1 | 12/1985 | Germany . |
| 3429031 A1 | 2/1986 | Germany . |
| 33 11 364 | 3/1991 | Germany . |
| 90 06 540 U | 3/1991 | Germany . |
| 0 469 465 A1 | 6/1992 | Germany . |

*Primary Examiner*—Charles R. Eloshway
*Attorney, Agent, or Firm*—Fitzpatrick, Cella, Harper & Scinto

[57] ABSTRACT

In a writing implement for ink, having a nib and having a shaft (3) a lamination system for holding or emitting ink is arranged, which lamination system has an ink feed channel (18) which runs in a longitudinally extending lamination carrier (10). Protruding from the lamination carrier (10) is a group of transversely arranged and mutually spaced laminations (24), between which laminations (24) there is a capillary gap (20) between the side of the lamination carrier (10) having the open side of the ink feed channel (18) and the inner wall (22) of the shaft (3). In a first region (34) which is located in the region of the open side of the ink feed channel (18), the laminations (24) each extend up to the inner wall (22) of the shaft (3). In a second region (36), which faces away from the first region (34) and extends over at least 80% of the circumference of the laminations (24), a distance, which prevents a capillary effect, from the inner wall (22) of the shaft (3), is maintained.

7 Claims, 1 Drawing Sheet

WRITING IMPLEMENT FOR INK

Figure 1:
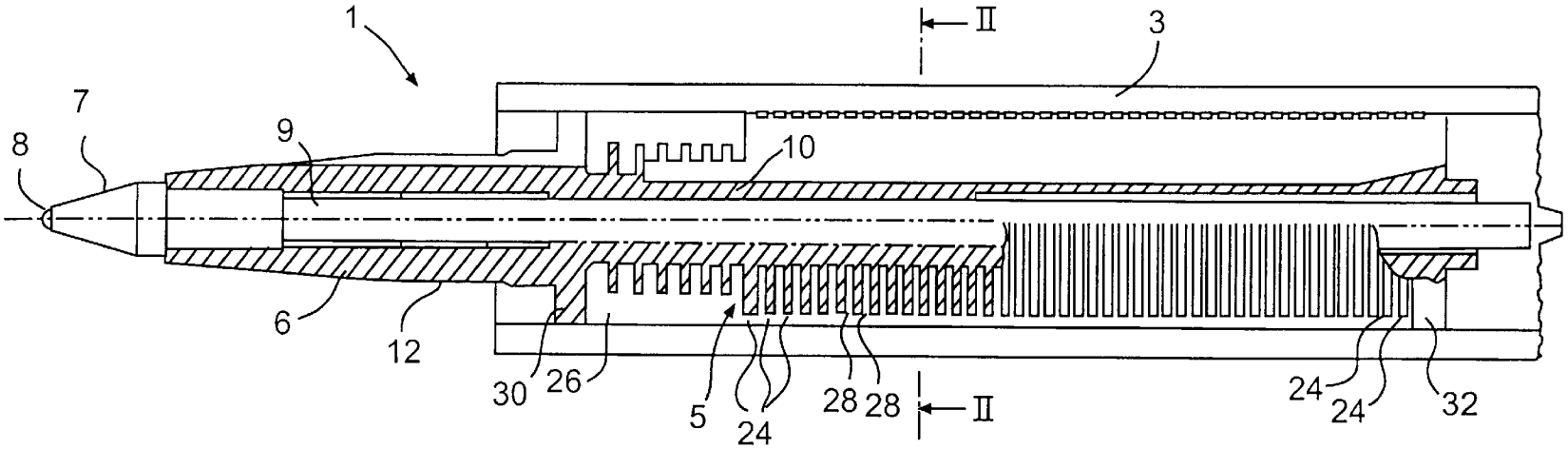

The invention relates to a writing implement for ink in accordance with the preamble of Patent claim 1.

Such a writing implement is known from DE 34 21 417 A1. This publication presents a fountain pen in which a lamination system for holding or emitting ink is arranged in the front region of the shaft. An ink feed channel connected to an ink reservoir runs in a longitudinally extending lamination carrier from which transversely arranged and mutually spaced laminations, also referred to as lamination discs or lamination fins, protrude. Between these laminations, there is a capillary gap between the side of the lamination carrier which has the open side of the ink feed channel and the inner wall of the shaft, via which capillary gap ink may emerge from the ink feed channel into the intermediate space between the laminations. Over the substantial part of their circumference, the laminations themselves extend directly as far as the inner wall of the shaft. The lamination system prevents disruptions in the inkflow occurring as a result of pressure or temperature fluctuations in the reservoir vessel for the ink, in that excessive ink is taken up and emitted again when required.

Writing implements with lamination systems of similar design are described in DE 34 29 031 A1 and DE 90 06 540 U1.

In the previously known writing implements it is disadvantageous that the capillary nature of the gap in the contact region between the laminations and the inner wall of the shaft can lead to ink becoming permanently stuck in this region between the laminations and the inner wall of the shaft. In writing implements whose shaft is transparent in the region of the lamination system, this leads to a "dirty" appearance.

There are also writing implements in which the laminations maintain a greater distance from the inner wall of the shaft over their entire circumference. However, such lamination systems are less sensitive and, under unfavourable conditions, ink may drip out from the tip of the writing implement.

Therefore, the object of the invention is to provide a writing implement for ink which has a particularly effective lamination system for holding or emitting ink.

This object is achieved by means of a writing implement for ink having the features of Patent claim 1. Advantageous refinements emerge from the subclaims.

In the case of the ink writing implement according to the invention, the laminations of one group of transversely arranged and mutually spaced laminations between which laminations there is a capillary gap between the side of the lamination carrier having the open side of the ink feed channel and the inner wall of the shaft extend in a first region which is located in the region of the open side of the ink feed channel, in each case up to the inner wall of the shaft of the writing implement. In a second region, which faces away from the first region and extends over at least 80% of the circumference of the laminations, the laminations of the group each maintain a distance from the inner wall of the shaft which is of such a magnitude that a capillary effect is prevented.

This design of the laminations ensures that the ink in the area of the first region of the laminations of the group can pass without difficulty from the ink feed channel into the intermediate space between the laminations via the capillary gap from the inner wall of the shaft or can move back from this intermediate space into the ink feed channel, depending on the pressure and temperature conditions in the ink reservoir vessel which is connected to the ink feed channel. In the second region, the laminations of the group are each at such a large distance from the inner wall of the shaft that it is not possible for the ink to creep along the lamination edge there under the effect of capillary forces. The writing implement according to the invention has a lamination system which reacts very sensitively to pressure or temperature fluctuations in the ink reservoir vessel. The tip is thus reliably relieved of loading and the formation of droplets is prevented.

In a preferred embodiment, the region of the shaft in which the lamination system is arranged is transparent. With such a design of the writing implement, a further advantage of the lamination system becomes apparent: Since the ink cannot collect at the edges of the laminations of the group in the second region because there is no capillary effect there, the lamination system appears clean. Only one longitudinally running strip on the inner wall of the shaft is wetted with ink, which strip is located in the vicinity of the open side of the ink feed channel, therefore in each case in the first region of the laminations of the group. Since this strip is bounded, it does not have the effect of "dirt" and may even give rise to an attractive aesthetic effect.

Preferably, the distance which prevents the capillary effect is at least 0.1 mm. The shape of the laminations of the group in the second region is not significant for the function of the lamination system; the said laminations there may be for example circular, elliptical, polygonal or irregular in shape. What is essential is that the distance from the inner wall of the shaft in the second region is of such a magnitude that the ink cannot creep to the lamination edge under the effect of capillary forces and remain their permanently.

In a preferred refinement, the laminations of the group in the second region each have a cut-out serving for ventilation purposes. In the cut-out, the distance of the edge of the respective lamination from the inner wall of the shaft is greater than in the other zones of the second region, as a result of which particularly reliable ventilation of the intermediate space between the laminations of the group is ensured. Ventilation is essential for the functioning of the lamination system.

In the writing implement according to the invention, the tip may be designed for example as a nib. In this case, the ink feed channel is connected not only to the ink reservoir vessel but also to the nib. In this arrangement, the ink moves in a manner known per se from the reservoir vessel via the ink feed channel to the tip.

In another refinement, the tip has a ball which is connected to the ink reservoir by a wick. In this case, the ink feed channel ends within the lamination system and does not extend as far as the tip. The ink is extracted via the wick, while, independently of this, the lamination system is connected to the ink reservoir vessel in order to compensate its pressure or temperature fluctuations.

The invention is explained in greater detail below with reference to an exemplary embodiment.

Figure 2:
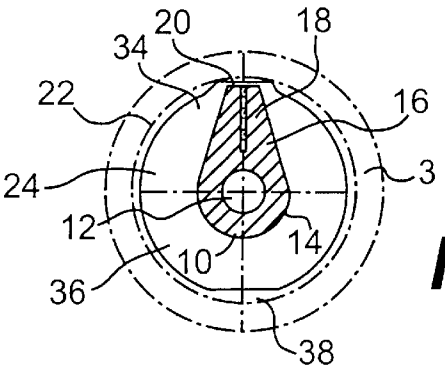

FIG. 1 shows a longitudinal section through the front region of a writing implement according to the invention, in which the tip has a ball, and FIG. 2 shows a cross-section through the writing implement along the line II—II in FIG. 1.

The exemplary embodiment (illustrated in FIGS. 1 and 2) of the writing implement 1 according to the invention is designed as a ball-point pen.

FIG. 1 shows the front region of a shaft 3 in which a lamination system 5 for holding or emitting ink is arranged. Such lamination systems are known in principle and, in the event of pressure or temperature fluctuations in the ink reservoir vessel, take up ink or emit it again, as a result of which the formation of droplets at the tip is avoided.

In the exemplary embodiment, the lamination system 5 is produced from one piece and is connected in one piece to a tube-like tip holder 6 which runs concentrically with respect to the longitudinal axis L—L of the writing implement 1 and emerges from the front end of the shaft 3. The tip holder 6 is fitted with a tip 7 which has a rotatably mounted ball 8 at its front end. The tip 7 is supplied with ink via a wick 9. The rear end of the wick 9 projects into an ink reservoir vessel which is arranged in the rear region of the shaft 3, i.e. to the right of the lamination system 5 in the representation according to FIG. 1, and is not illustrated in the figures. In the exemplary embodiment, the ink reservoir vessel cannot be replaced. However, the writing implement according to the invention may also be designed for example as a cartridge pen with replaceable cartridge.

The lamination system 5 has a lamination carrier 10 which extends in the direction of the longitudinal axis L—L of the writing implement 1. The lamination carrier 10 is provided in its interior with a passage 12 for holding the wick 9. There is no direct connection between the passage 12 and the outer space of the lamination carrier 10.

FIG. 2 shows a cross-section of the lamination carrier 10 (hatched) along the axis II—II from FIG. 1. Here, the lamination carrier 10 is of round design in the cross-sectional contour in the lower region 14, the radius being substantially smaller than that of the shaft 3. In its upper region 16, the lamination carrier 10 extends almost up to the inner wall 22 of the shaft 3. (The terms "at the top" and "at the bottom" relate here to the orientation of the lamination carrier 10 illustrated in FIG. 2). In the upper region 16 there is an ink feed channel 18 which is connected to the ink reservoir vessel. Between the side of the lamination carrier 10 which has the open side of the ink feed channel 18, and the inner wall 22 of the shaft 3 there is a capillary gap 20 which is also referred to as an overflow. In the exemplary embodiment, the capillary gap 20 is provided on both sides of the ink feed channel 18. Alternatively, a capillary gap could also be formed on only one side of the ink feed channel 18, between the upper region 16 of the lamination carrier 10 and the inner wall 22 of the shaft 3, while the upper region 16 on the opposite side of the ink feed channel 18 touches the inner wall 22 of the shaft 3. The capillary gap 20 is so narrow that ink may travel from the ink feed channel 18 into the outer space of the lamination carrier 10 under the effect of capillary forces.

Attached to the lamination carrier 10 are mutually spaced laminations whose planes run transversely with respect to the longitudinal axis L—L of the writing implement 1. These laminations may be arranged in a plurality of groups, the laminations of one group having an identical, or largely identical, cross-sectional contour. Two groups of laminations are provided in the exemplary embodiment, namely the laminations 24 described in greater detail below, with the cross-section (not hatched) shown in FIG. 2 and a further group 26 in which the edges of the laminations are at a greater distance from the inner wall 22 of the shaft 3. Formed between the laminations 24, 26 are chambers 28 which are connected to one another via the ink feed channel 18 and also the outer regions of the laminations 24, 26 and serve to hold ink. At the front, the lamination system 5 is closed off by a wall 30 with an air passage; at the rear it is closed off by a wall 32, see FIG. 1. Using the walls 30 and 32, the lamination system 5 is attached in the shaft 3.

Here, where the lamination carrier 10 has the cross-sectional contour described with reference to FIG. 2, the laminations 24 are designed in the way also represented in FIG. 2 for the sake of clarity. In a first region 34 which is located in the region of the open side of the ink feed channel 18, therefore at the capillary gap 20, the laminations 24 extend in each case up to the inner wall 22 of the shaft 3. That is to say they touch the inner wall 22 of the shaft 3 directly or they are at a very small distance from it, which distance is even smaller than the width of the capillary gap 20. In a second region 36, which faces away from the first region 34, the laminations 24 each maintain a distance from the inner wall 22 of the shaft 3. This distance is of such a magnitude that no capillaries which draw ink via the intermediate space between a lamination 24 and the inner wall 22 of the shaft 3 from the chamber 28 on one side of the lamination 24 into the chamber 28 on the other side of this lamination 24 are formed there. In particular, ink is also prevented from collecting in the intermediate space and remaining there permanently.

The second region 36 extends over at least 80% of the circumference of the laminations 24; in the exemplary embodiment over approximately 90% of the circumference. On both sides of the ink feed channel 18, the transition zone between the first region 34 and the second region 36 is relatively narrow, see FIG. 2.

A capillary effect can be avoided, as a rule, if the laminations 24 in the second region 36 each maintain a distance of at least 0.1 mm from the inner wall 22 of the shaft 3. However, this distance may also be greater. The cross-sectional contour of the laminations 24 may also be different from the largely circular contour according to FIG. 2. The significant point here is that the distance from the inner wall 22 should be greater than the distance between two adjacent laminations 24 so that ink is prevented from adhering to the inner wall as a result of the capillary effect between the laminations which is then greater with respect to the distance from the inner wall.

Within the second region 36, the laminations 24 each have a cut-out 38 in whose region the distance from the inner wall 22 of the shaft 3 is greater than elsewhere in the second region 36. The cut-out 38 of the laminations 24 facilitate the ventilation of the chambers 28 between the laminations 24. Further details of the ventilation device for the lamination system 5 are not illustrated in FIGS. 1 and 2. The ventilation, which is essential for the functioning of the lamination system 5, takes place in a manner known per se.

In the ink ball-point pen shown in FIGS. 1 and 2, the ink feed channel 18 is connected to the ink reservoir vessel but ends in the front region of the lamination system 5, i.e. it does not lead as far as the tip 7. In contrast, if the tip is designed as a nib, a connection is provided between the ink feed channel and the nib so that the ink is directed via the ink feed channel from the ink reservoir vessel to the nib. The passage 12 is omitted in this case.

In both cases, the lamination system 5 serves as an equalizing system in order to take up ink or emit it again in the event of pressure or temperature fluctuations in the ink reservoir vessel. In this context, the ink moves through the ink feed channel 18 via the respective capillary gap 20 into the chambers 28 between the laminations 24. A relatively large amount of ink may be held between the laminations of the further group 26; here, the distance between the ink feed channel 18 and the inner wall 22 of the shaft 3 is of such a magnitude that no capillary effect occurs.

Overall, the lamination system 5 functions in a manner known per se, but it is particularly effective because of the design of the cross-sectional contour of the laminations 24. The filling and emptying of the chambers 28 takes place via the respective capillary gap 20, the ink being prevented from travelling directly into the adjacent chambers as a result of the design of the laminations 24, bounding the respective capillary gap 20 in the first region 34. The equalizing effect of the lamination system 5 is therefore sensitive. An undesired capillary effect is avoided at the laminations 24 in the second region 36. Therefore, the lamination system 5 can be virtually completely emptied, and the undesired formation of droplets at the tip 7 does not occur.

If the region of the shaft 3 in which the lamination system 5 is arranged is transparent, a further advantage of the design of the laminations 24 becomes apparent. In the long term, ink may remain only in the respective first region 34 on the laminations 24, which is visible from the outside as a longitudinally running strip. In contrast, in the other zones, the lamination system 5 appears clear. The impression of dirtying does not arise.

I claim:

1. A writing implement for ink, comprising a tip (7) and a shaft (3) in which a lamination system (5) for holding or emitting ink is arranged, said lamination system including an ink feed channel (18) running in a longitudinally extending lamination carrier (10) from which a group of transversely arranged and mutually spaced laminations (24) protrudes, wherein a capillary gap (20) is defined between a side of the lamination carrier (10) having an open side of the ink feed channel (18) and the inner wall (22) of the shaft (3), and by the laminations (24) in a first region, (34) of the group which are located proximate to the open side of the ink feed channel, (18), and extend up to the inner wall (22) of the shaft (3), and while in a second region (36) of the group, which faces away from the first region (34) and extends over at least 80% of the circumference of the laminations (24), each lamination maintains a distance, which is large enough to prevent a capillary effect and thereby keeps ink away, from the inner wall (22) of the shaft (3), wherein, further, in the second region, the laminations of the group each have a cut-out for ventilating said lamination system.

2. The writing implement according to claim 1 wherein the region of the shaft (3) in which the lamination system (5) is arranged is transparent.

3. The writing implement according to one of claims 1 or 2, wherein the distance which prevents the capillary effect is at least 0.1 mm.

4. The writing implement according to one of claims 1, or 2, wherein the second region (36) extends in each case over at least 90% of the circumference of the laminations (24) of the group.

5. The writing implement according to one of claims 1, or 2, wherein the tip is designed as a nib which is connected to the ink feed channel.

6. The writing implement according to one of claims 1, or 2, wherein the tip (7) has a ball (8) which is connected to the ink reservoir via a wick (9).

7. A writing implement for ink, comprising:

a tip;

a shaft; and a lamination system for holding or emitting ink, wherein said lamination system is arranged in said shaft, said lamination system further comprising:

a lamination carrier in which an ink feed channel runs;

a group of transversely arranged and mutually spaced laminations protruding from said lamination carrier comprising two regions; wherein, in a first region, which is located proximate to an open side of the ink feed channel, each lamination extends up to the inner wall of said shaft, and a capillary gap is formed between a side of said lamination carrier having an open side of the ink feed channel and the inner wall of said shaft; and wherein, in a second region, which faces away from the first region and extends over at least 80% of the circumference of the laminations, each lamination maintains a distance from the inner wall of said shaft which is large enough to prevent flow of ink by capillary action between the laminations in said second region and the inner wall of said shaft to thereby keep ink away from said inner wall.

* * * * *